US006397503B1

(12) United States Patent
Cain et al.

(10) Patent No.: US 6,397,503 B1
(45) Date of Patent: Jun. 4, 2002

(54) FOOD AGE ORGANIZATION SYSTEM

(76) Inventors: Keith Cain; Janet Cain, both of 900 Aukerman St., Eaton, OH (US) 45320

( * ) Notice: Subject to any disclaimer, the term of this patent is extended or adjusted under 35 U.S.C. 154(b) by 0 days.

(21) Appl. No.: 09/178,951

(22) Filed: Oct. 26, 1998

(51) Int. Cl.[7] ..... G09D 3/02; G09D 3/04
(52) U.S. Cl. ..... 40/110; 116/205; 116/307
(58) Field of Search ..... 40/110, 637; 62/125; 116/205, 307; 235/385

(56) References Cited

U.S. PATENT DOCUMENTS

| | | | | | |
|---|---|---|---|---|---|
| 3,001,308 | A | * | 9/1961 | Potter | 40/110 |
| 3,818,858 | A | | 6/1974 | Kramer et al. | |
| 3,837,100 | A | * | 9/1974 | Guida | 40/637 |
| 3,975,848 | A | * | 8/1976 | Schmid | 40/110 |
| 4,292,916 | A | | 10/1981 | Bradley et al. | 116/205 |
| 4,619,221 | A | | 10/1986 | Linstromberg | 116/307 |
| 4,895,257 | A | * | 1/1990 | Winslow | 116/205 X |
| 5,335,509 | A | | 8/1994 | Namisniak et al. | 62/125 |
| 5,487,276 | A | | 1/1996 | Namisniak et al. | 62/125 |
| 5,691,684 | A | | 11/1997 | Murrah | 235/385 |
| 5,711,160 | A | | 1/1998 | Namisniak et al. | 62/125 |
| 5,755,337 | A | | 5/1998 | Linn | 211/13.1 |
| 5,934,707 | A | * | 8/1999 | Johnson | 40/110 X |

* cited by examiner

*Primary Examiner*—Jack Lavinder
(74) *Attorney, Agent, or Firm*—John D. Gugliotta

(57) ABSTRACT

A food age organization system that provides the user with a convenient way by which to label the leftover food containers in their refrigerators, indicating the date upon which it was placed therein. Simple in design, the system incorporates a color-coding system wherein the date upon which a food storage container was placed in a refrigerator can be ascertained quickly and easily.

5 Claims, 4 Drawing Sheets

FOOD AGE ORGANIZATION SYSTEM

BACKGROUND OF THE INVENTION

1. Field of the Invention

The present invention relates generally to food freshness monitoring systems, and more specifically to a system for keeping track of the date food was placed in a refrigerator so as to prevent the spoilage thereof prior to consumption.

2. Description of the Related Art

While grocery shopping, one must be constantly aware of product dating codes in order to ensure that safe and fresh food products are purchased. This practice, however, does not end at the grocery store. Rather, it is equally important to monitor the expiration date on products in the home to make sure that only the freshest non-outdated food is consumed. This is especially the case where prepared food or leftovers are placed in the refrigerator for future use. These foods are especially susceptible to deterioration and contamination over time due to the fact that, many times, they have set out at room temperature for some period prior to storage. Obviously, the containers used to store leftovers and the like do not carry any dating information and, as a result, are even more difficult to keep track of. As a result, there is a need for a means by which consumers can keep track and maintain a record of what foods in their refrigerators are the freshest, alerting them of potential problems associated with food aging in a manner that is easy to use and requires little effort on the part of the consumer. The development of the present invention provides this solution by the utilization of color coded indicia that correlate food containers with the date upon which they were placed in a refrigerator or the like.

A search of the prior art did not disclose any patents that read directly on the claims of the instant invention. However, several references to food age recording devices and systems were discovered. However, these devices neither anticipate nor disclose any embodiment that would preclude its novelty and the utilitarian functionality of the features of the present invention.

Several patents describe methods of tracking and dating food storage through the use of data recorded on preprinted magnetic labels in conjunction with an electronic data storage and time recording means:

U.S. Pat. No. 5,711,160, issued in the name of Namisniak et al.;

U.S. Pat. No. 5,487,276, issued in the name of Namisniak et al.; and

U.S. Pat. No. 5,335,509, issued in the name of Namisniak et al.

In these disclosures, the user enters the food type and date into the electronic recorder and prepares a corresponding label for the food container. When the food reaches an age where it is unfit to consume, a warning is displayed. Color coding between the recorder and the container labels is anticipated. All of these systems are unnecessarily complicated and, as a result, would be excessively expensive. The use of sticker labels on the food storage containers could pose a problem in that they can be difficult to remove after use.

U.S. Pat. No. 4,619,221, issued in the name of Linstromberg, discloses an inventory indicating device with a combination slidable food-type and date indicator that attaches to the storage bins in a refrigerator for recording the date of origin of the contents thereof.

U.S. Pat. No. 5,755,337, issued in the name of Linn discloses a method of tracking and dating food stored with color-coded flags wherein the date and contents of a food storage container are written down on a refrigerator door mounted note pad. Each entry on the note pad is associated with a distinct color. An adhesive label of a color that corresponds to the note pad entry is affixed to the container. Thus, the user can determine the contents and date of the contents of a food storage container based upon the color of the label thereon.

U.S. Pat. No. 3,818,858, issued in the name of Kramer et al., discloses a food storage container that incorporates a dating device for indicating the date upon which food was placed therein. However, there are no means for indicating the contents of the container.

U.S. Pat. No. 5,691,684, issued in the name of Murrah describes a food storage inventory bar coding system.

U.S. Pat. No. 4,292,916, issued in the name of Bradley et al. describes a chemical indicator for determining freshness of foodstuffs.

While several features exhibited within these references may be incorporated into this invention, alone and in combination with other elements, none address the specific problems addressed by the present invention, namely the disadvantages of using an adhesive labeling means, complicated electronic and manual data recording procedures/devices and excessive costs. As such, the present invention is sufficiently novel and different so as to make it distinguishable over the prior art.

SUMMARY OF THE INVENTION

The present invention is a food age organization system that provides the user with a convenient means by which to label the leftover food containers in their refrigerators, indicating the date upon which it was placed therein. Simple in design, the system consists of circular magnets that are attached to the storage containers. When food is placed inside the container, a colored indicator is secured to the container via the magnet. The colored indicator corresponds to the day of the week that the food was stored and is indicated by a colored, magnetic indicator that is attached to a calendar hanging on the refrigerator door. By matching the color of the indicator on the container with the color on the calendar, one can use the system to determine the exact day upon which the food was first placed in the refrigerator. Additionally, the container indicators come in a variety of shapes that indicate the type of food in the containers. As a result, use of the food age organization system provides the user with a means by which to avoid the waste associated with food spoilage.

It is therefore an object of the present invention to provide a food age organization system that will allow the user to accurately keep track of the age of foods stored in a refrigerator or the like.

It is another object of the present invention to provide a food age organization system that does not require the use of stickers or adhesive labels that are difficult to remove after use.

It is another object of the present invention to provide a food age organization system that is simple to use and inexpensive to produce, as an alternative to existing electronic food age recording devices and systems.

It is another object of the present invention to provide a food age organization system that utilizes color coded and/or textured age indication indicia that correspond to a calendar date, indicating the date upon which a food storage container was placed in a refrigerator.

It is another object of the present invention to provide a food age organization system that incorporates the use of a ferromagnetic securing device to secure age indication indicia to food storage containers.

Finally, it is an object of the present invention to provide a food age organization system wherein the age indication indicia are formed to a shape indicating the type of food stored in the food storage container.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| LIST OF REFERENCE NUMBERS | |
|---|---|
| 10 | Calendar |
| 11 | Food Age Organization System |
| 12 | Hook Apertures |
| 13 | Date Squares |
| 15 | Magnetic Marker |
| 16 | Ferromagnetic Base |
| 17 | Colored Surface |
| 20 | Food Storage Container |
| 21 | Food Receptacle |
| 22 | Lid |
| 23 | Anchoring Plate |
| 25 | Food-Specific Magnetic Markers |
| 26 | Meat Marker |
| 27 | Poultry Marker |
| 28 | Fish Marker |
| 29 | Vegetable Marker |

DESCRIPTION OF THE PREFERRED EMBODIMENTS

1. Detailed Description of the Figures

Figure 1:
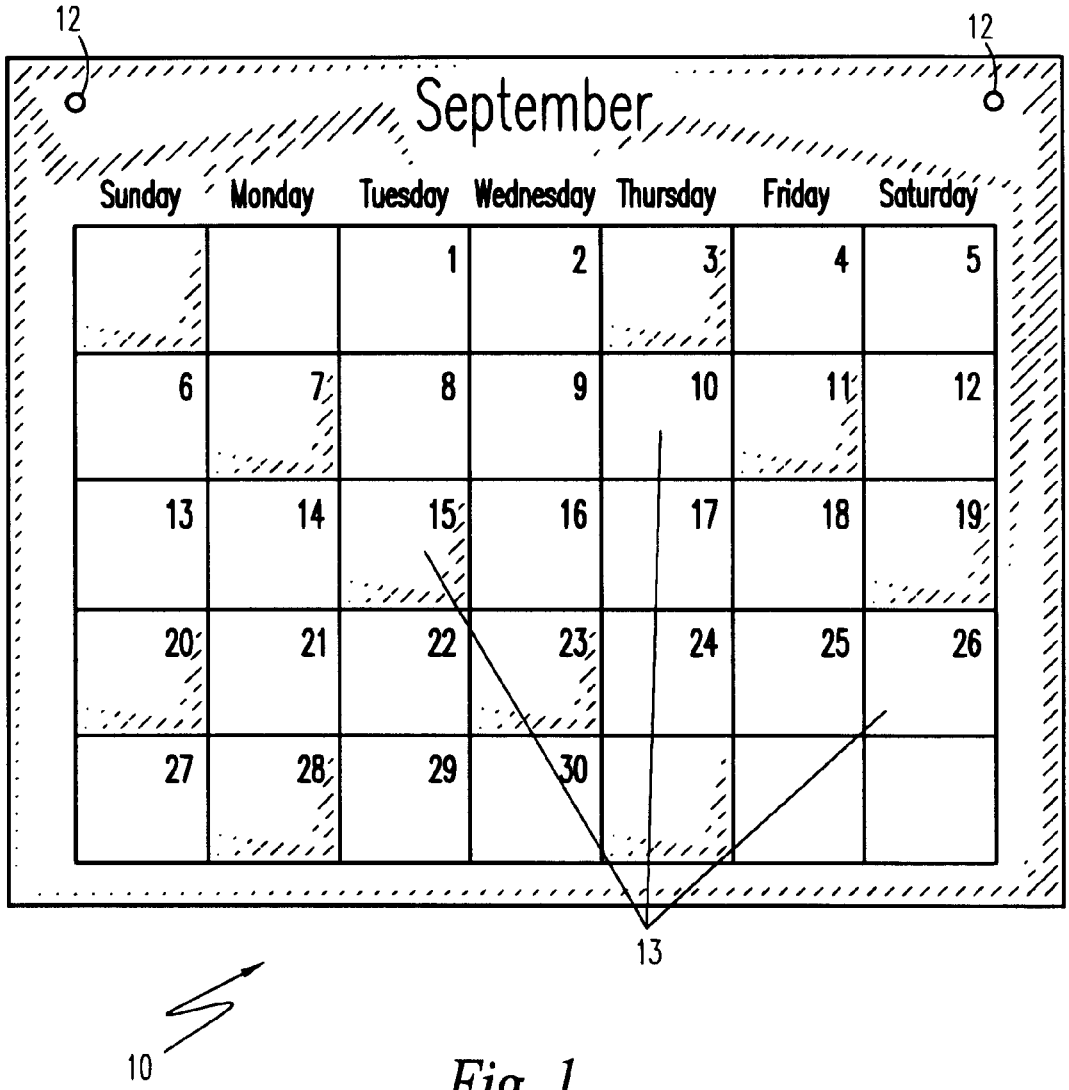
FIG. 1 is a front view of a calendar for use in conjunction with a food age organization system, according to the preferred embodiment of the present invention.

Referring now to FIG. 1, depicted is a calendar 10 used in conjunction with the food age organization system 11, according to the preferred embodiment of the present invention. It should be understood that, although a single month is depicted on the calendar 10, it has been done solely for demonstration purposes and the appropriate month/year combination is to be used, depending upon the date of use. The calendar 10 is designed to be secured to a conventional refrigerator door (not shown) and is constructed having either a ferromagnetic backing material (not shown) or of a non-magnetic material of a weight and thickness such that conventional refrigerator-type magnets can secure it in place on the refrigerator surface. The calendar 10 also includes a pair of hook apertures 12 that provide an alternative securing means. The calendar 10 includes a plurality of large date squares 13 that correspond to the days of the month/year.

Figure 2:
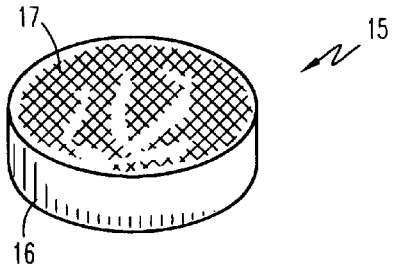
FIG. 2 is a perspective view of a magnetic marker for use in conjunction with a food age organization system, according to the preferred embodiment of the present invention.

Referring now to FIG. 2, depicted is a magnetic marker 15 for use in conjunction with the food age organization system 11, according to the preferred embodiment of the present invention. The magnetic marker 15 is generally disc-like in shape, although other shapes are suitable, and consists of a ferromagnetic base 16 and a colored surface 17. The colored surface 17 is achieved via painting, enamel coating, lamination, adhesive stickers, or other like conventional means, incorporating a variety of distinguishable colors. In an alternate embodiment, the magnetic markers 15 include a textured surface (not shown) that allows users with limited vision to distinguish them between one another. The magnetic markers 15 serve several functions in the use of the food age organization system 11 that will be discussed in further detail herein below.

Figure 3A:
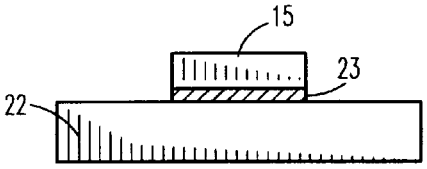
FIG. 3*a* is a side view of a conventional food storage container having a magnetic marker affixed thereto, according to the preferred embodiment of the present invention.
Figure 3:
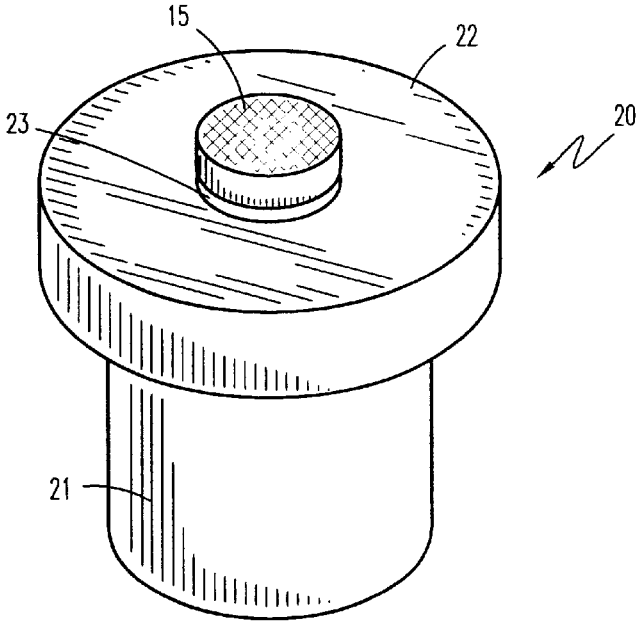
FIG. 3 is a perspective view of a magnetic marker affixed to a conventional food storage container, according to the preferred embodiment of the present invention.

Referring now to FIGS. 3 and 3*a*, depicted is a conventional food storage container 20. The food storage container 20 consists of a food receptacle 21 and a lid 22. The lid 22 is adapted so as to allow for its use in conjunction with the food age organization system 11. An anchoring plate 23 is affixed to the lid 22 using any conventional adhesive means. The anchoring plate 23 is of either a ferrous or ferromagnetic construction that allows for removably attaching a magnetic marker 15 thereto.

Figure 4:
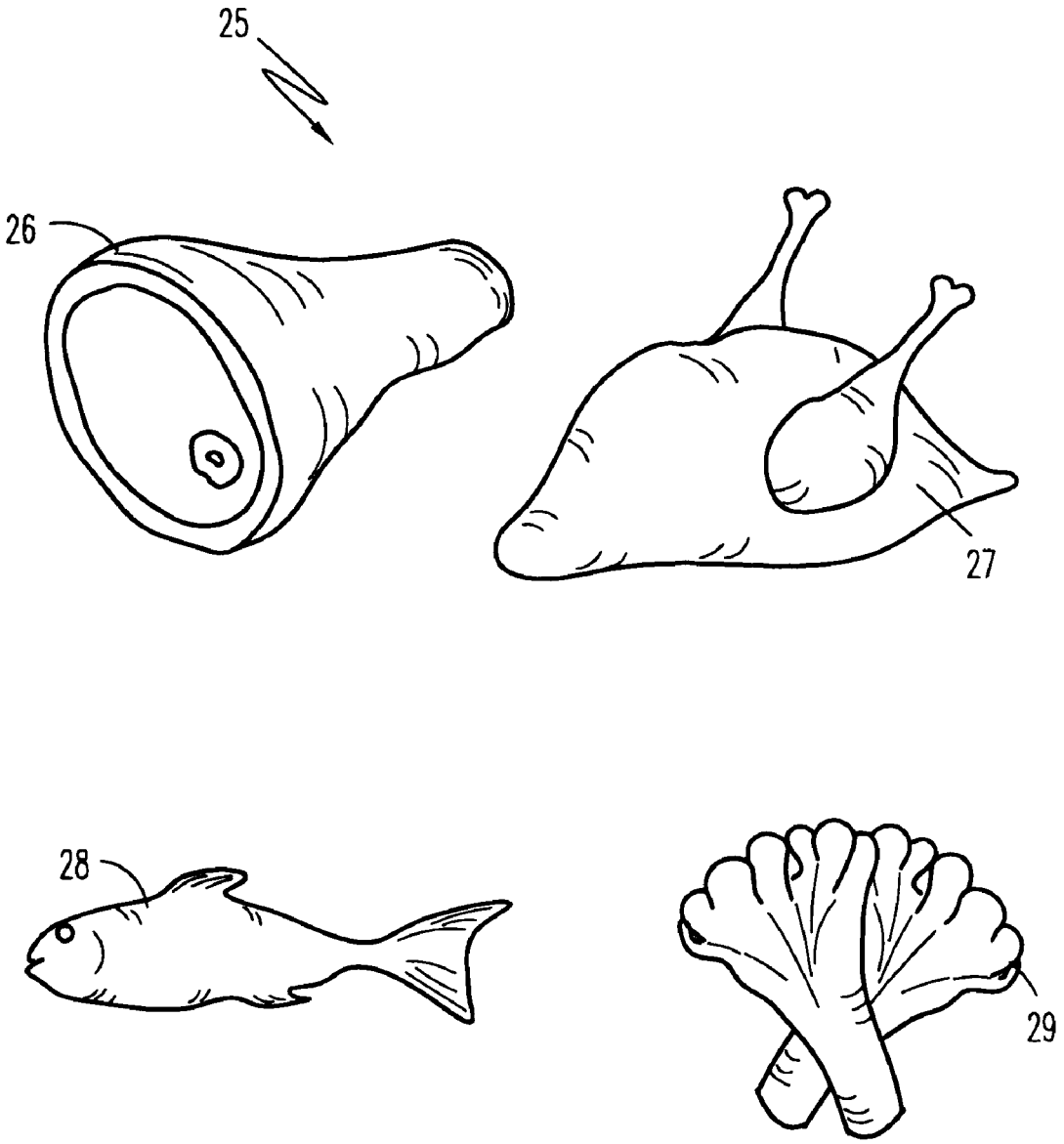
FIG. 4 is a front view of a variety of food specific magnetic markers for use in conjunction with a food age organization system, according to the preferred embodiment of the present invention.

Referring now to FIG. 4, depicted are a variety of food-specific magnetic markers 25 for use in conjunction with the food age organization system 11. Secured to an anchoring plate 23 affixed to a food storage container 20, the food-specific magnetic markers 25 are used to convey a food type identification of the contents thereof. These food types include, but are not limited to a meat marker 26, a poultry marker 27, a fish marker 28 and a vegetable marker 29. Similar in construction to the magnetic markers 15 described herein above, the food-specific magnetic markers 25 consists of a ferromagnetic base (not shown) and a colored surface (not depicted in the figure). The colored surface is achieved via painting, enamel coating, lamination, adhesive stickers, or other like conventional means, incorporating a variety of distinguishable colors. In an alternate embodiment, the food-specific magnetic markers 25 include a textured surface (not shown) that allows users with limited vision to distinguish them between one another. Furthermore, the shape of the food-specific magnetic markers 25 is such that the associated food type is ascertainable by feel rather than sight. Configured as such, the food-specific magnetic markers 25 can replace the magnetic markers 15 secured to the anchoring plate 23 on the lid 22, thus providing food type identification indicia on the food storage container 20.

2. Operation of the Preferred Embodiment

Figure 5:
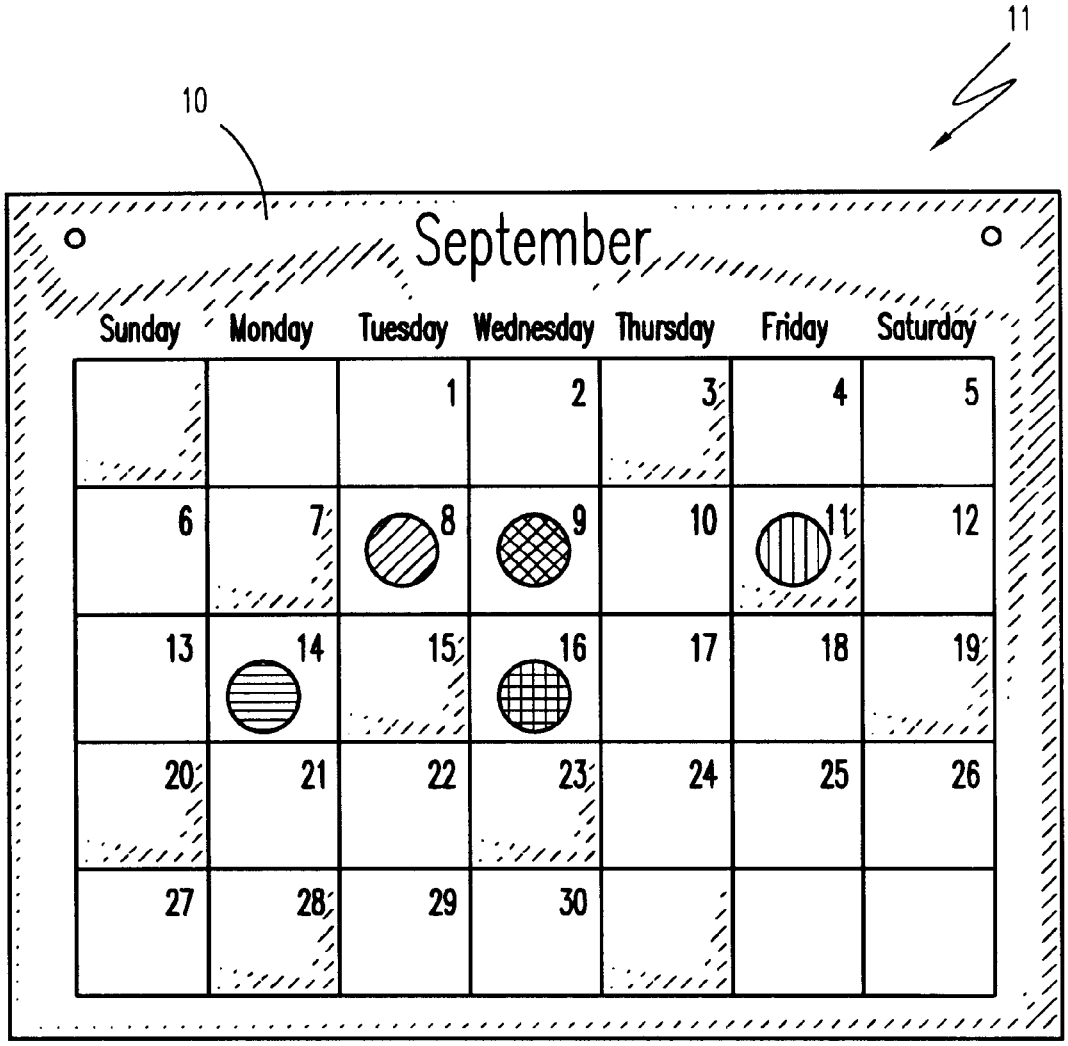
FIG. 5 is a front view of the food age organization system depicting its use in accordance with the preferred embodiment of the present invention.

In accordance with the preferred embodiment of the present invention and as shown in the Figures, especially FIG. 5, the food age organization system is used in the following manner. The calendar 11 is affixed to the door of a conventional refrigerator (not shown). When the user places a food storage container 20 inside the refrigerator, a magnetic marker 15 is placed on the lid 22, magnetically affixed to the anchoring plate 23. The user also places a magnetic marker 15 on the calendar 10 in the date square 13 corresponding to the present day of the month. The magnetic marker 15 placed on the food storage container 20 and the magnetic marker on the calendar 10 should be of the same color and/or texture. Thus, the user can determine the date upon which any particular food storage container 20 was placed in the refrigerator by correlating the color of the magnetic marker 15 on the lid 22 with the matching color on the calendar 10. Accordingly, care should be taken so that the same color/texture is used on only one day so as to avoid confusion in ascertaining the date upon which the food was placed in the refrigerator.

In accordance with an alternate embodiment of the present invention, the food-specific magnetic markers 25 are used in place of the magnetic markers 15 on the lid 22 only, allowing the user to ascertain not only the date upon which the food was placed in the refrigerator, but also the type of food in any particular food storage container 20. As described herein above, the shape of the food-specific magnetic markers 25 indicate a variety of food types. The colored and/or textured surfaces of the food-specific magnetic markers 25 allows the user to correlate the date upon which the food storage container 20 was placed in the refrigerator using the magnetic markers 15 in conjunction with the calendar 10.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. A food age organization system comprising:

a plurality of marker means; each of said marker means comprising a ferromagnetic base supporting identification indicia;

an anchoring plate having a ferrous composition, said anchoring plate being permanently affixed to the lid of a food storage container and allowing for the removable attachment of said marker means thereto; and calendar means for correlating said markers to a particular date, whereby the date upon which said food storage container was placed inside a refrigerator can be ascertained by matching said identification indicia of said marker means attached to said lid to said identification indicia of said marker means attached to said calendar means.

2. The food age organization system of claim 1 wherein said identification indicia further comprises a variety of individual colored coatings or textures surfaces.

3. The food age organization system of claim 2 wherein said marker means further comprises a shape corresponding to a particular food type or food group, allowing the user to further identify a food contained in said food storage container attaching said marker means to said lid.

4. The food age organization system of claim 2 wherein said calendar means is secured to the door of a refrigerator in a location of convenient display and access, said ferromagnetic base securing said marker means to the ferrous base material typically found in refrigerator door constructions.

5. The food age organization system of claim 2 wherein the shape of said marker means and the texture of said identification indicia are readily ascertainable by touch, allowing for use by those with vision impariment.

* * * * *

UNITED STATES PATENT AND TRADEMARK OFFICE

CERTIFICATE OF CORRECTION

PATENT NO. : 6,397,503 B1
DATED : June 4, 2002
INVENTOR(S) : Cain et al.

It is certified that error appears in the above-identified patent and that said Letters Patent is hereby corrected as shown below:

Title page,
Item [*] Notice, delete "0" and insert -- 81 --.

Signed and Sealed this

Thirtieth Day of August, 2005

JON W. DUDAS
*Director of the United States Patent and Trademark Office*